US008381958B2

(12) United States Patent
Lussier et al.

(10) Patent No.: US 8,381,958 B2
(45) Date of Patent: Feb. 26, 2013

(54) BUTTON ATTACHMENT KIT

(75) Inventors: Pauline M. Lussier, Woonsocket, RI (US); Michael French, Winchester (GB); David L. Schuttler, Townsend, MA (US)

(73) Assignee: Avery Dennison Corporation, Pasadena, CA (US)

( * ) Notice: Subject to any disclaimer, the term of this patent is extended or adjusted under 35 U.S.C. 154(b) by 372 days.

(21) Appl. No.: 12/660,887

(22) Filed: Mar. 5, 2010

(65) Prior Publication Data

US 2010/0230462 A1 Sep. 16, 2010

Related U.S. Application Data

(60) Provisional application No. 61/209,400, filed on Mar. 6, 2009.

(51) Int. Cl.
*A41H 37/10* (2006.01)

(52) U.S. Cl. ..... 227/67; 227/68; 227/70; 227/120; 227/135; 227/136; 227/147; 173/90

(58) Field of Classification Search ..... 227/67–68, 227/70, 120, 135, 136, 147; 206/346, 366; 173/90; 16/110.1, 430; 81/177.1, 177.4
See application file for complete search history.

(56) References Cited

U.S. PATENT DOCUMENTS

| | | | | | |
|---|---|---|---|---|---|
| 3,470,834 | A | * | 10/1969 | Bone | 112/104 |
| 3,815,798 | A | | 6/1974 | Lavitch et al. | |
| 4,290,465 | A | * | 9/1981 | Fee et al. | 81/177.1 |
| 5,336,011 | A | * | 8/1994 | Ferguson et al. | 401/247 |
| 5,482,196 | A | | 1/1996 | Doyel | |
| 5,495,974 | A | | 3/1996 | Deschenes et al. | |
| 5,499,562 | A | * | 3/1996 | Feng | 81/177.4 |
| 5,518,162 | A | | 5/1996 | Deschenes et al. | |
| 5,938,024 | A | | 8/1999 | Deschenes et al. | |
| 5,975,398 | A | | 11/1999 | Evans | |
| 6,267,286 | B1 | | 7/2001 | Deschenes et al. | |
| 2002/0121538 | A1 | * | 9/2002 | Cooper et al. | 227/67 |

* cited by examiner

*Primary Examiner* — Brian D Nash
*Assistant Examiner* — Michelle Lopez
(74) *Attorney, Agent, or Firm* — Kriegsman & Kriegsman

(57) ABSTRACT

A self-contained button attachment kit includes a pair of buttons, fastener clips and a tool for dispensing a fastener from a fastener clip to reattach a button to an article of clothing. The tool includes a single, hollow needle, a holder adapted to retain the needle and buttons, a handle telescopingly mounted on the holder, a spring-biased ejection mechanism connected to the handle, a front cap removably coupled to the handle over the needle and a rear cap removably coupled to the handle for storing fastener clips. In operation, the front cap serves as an anvil that supports the article and button to be attached. With a fastener clip loaded into the holder, the needle is then inserted through the pair of items. Displacement of the handle relative to the holder causes an ejection rod to dispense the cross-bar of a fastener through the needle, thereby completing the attachment process.

18 Claims, 18 Drawing Sheets

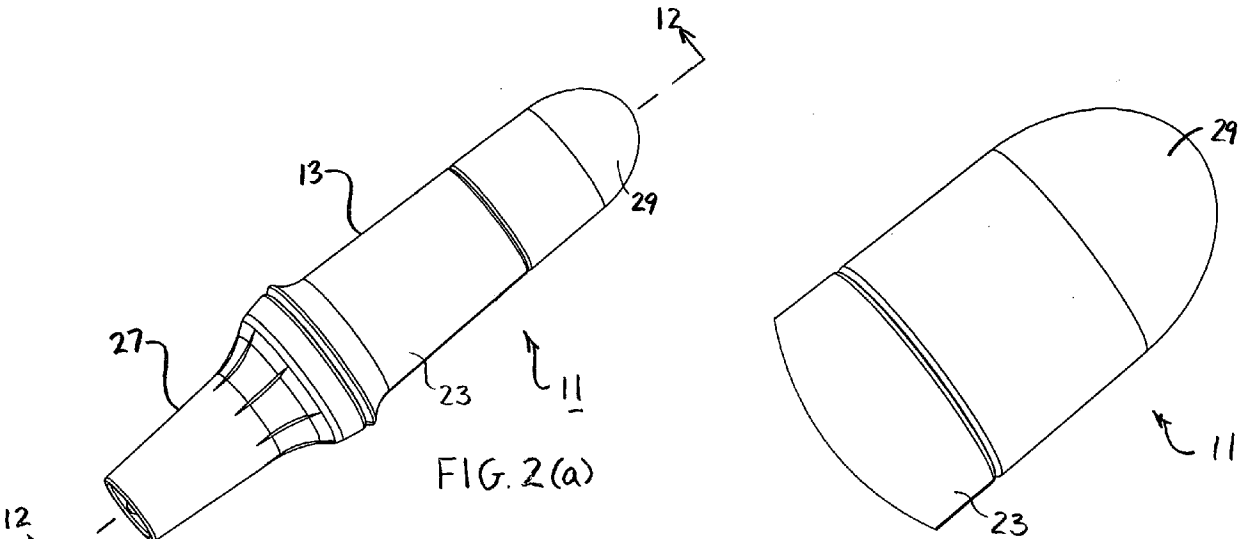
FIG. 2(a)
FIG. 2(b)
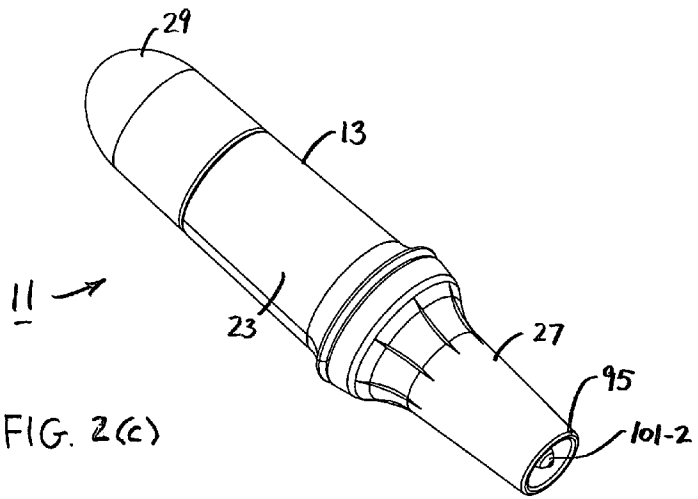
FIG. 2(c)

BUTTON ATTACHMENT KIT

CROSS-REFERENCE TO RELATED APPLICATIONS

The present application claims the benefit under 35 U.S.C. 119(e) of U.S. provisional Patent Application Ser. No. 61/209,400, filed Mar. 6, 2009, the disclosure of which is incorporated herein by reference.

BACKGROUND OF THE INVENTION

The present invention relates generally to handheld fastener dispensing devices and more specifically to a novel kit that is particularly well-suited for use in attaching a button to an article of clothing.

Traditionally, detached buttons are sewn back onto articles of clothing using a needle and thread. However, the act of sewing a button onto an article using a needle and thread has been found to be a rather time-consuming and highly dexterous process. As a result, consumers that require the re-attachment of a button to an article often either employ a professional seamstress for the task, typically at a substantial cost, or permanently discard the article.

In response to the shortcomings associated with the traditional sewing process, button attachment kits have recently been developed that greatly simplify the manner in which detached buttons can be re-attached to articles of clothing, each button fastening kit typically comprising, inter alia, one or more clips of plastic fasteners, a handheld fastener dispensing tool and a small sampling of individual buttons. As will be described further in detail below, the handheld tool is designed to separate a fastener from the fastener clip and, in turn, dispense the fastener through the detached button and the intended garment to securely re-attach the separated objects. One well known button attachment kit is manufactured and sold by Avery Dennison Corporation of Pasadena, Calif. under its BUTTONEER® line of fastening systems.

In U.S. Pat. No. 5,495,974, the disclosure of which is incorporated herein by reference, there is shown a button attachment kit which comprises a fastener attaching tool and a complementary fastener clip, the fastener clip including a pair of runner bars and one or more U-shaped fasteners having transverse bars at opposite ends, each transverse bar being connected to a corresponding runner bar by a severable connector post. The fastener attaching tool includes a pair of needles, each needle having longitudinal slotted bore adapted to receive one of the transverse bars and a knife edge formed on one side which is adapted to sever a connector post from its associated transverse bar as the transverse bar is pushed through the needle. The body of the tool includes a transverse feed slot through which the fastener clip is manually inserted, the feed slot being situated directly behind the pair of needles. The tool also includes an ejector mechanism that is slidably mounted back and forth within the tool body and is rearwardly biased by a spring. The ejector mechanism is manually operable from the rear of the body and includes a pair of ejector rods that are disposed to slide back and forth through the bore of corresponding needles and, in turn, push the transverse bars of the lowermost fastener in the loaded fastener clip out through the open sharpened tip of the needles. Other patents of interest include U.S. Pat. No. 5,518,162 to Deschenes et al., and U.S. Pat. No. 6,267,286 to Deschenes et al., both disclosures being incorporated herein by reference.

In use, fastener dispensing tools of the type described in the '974 patent are typically handled and operated like a syringe. Specifically, the index and middle fingers of the user are disposed either through openings in the front of the tool body or, in the alternative, against the front surface of the tool body on opposite sides of the pair of needles. In addition, the thumb of the user is disposed against the exposed rear surface of the ejector block for the ejector mechanism. Handled in this manner, the tool is manually driven by the user such that the sharpened tip of each needle penetrates through an opening in the detached button and through the intended garment. At this time, fastener actuation is achieved by manually pushing the ejector block forward using the thumb of the user.

Fastener dispensing tools of the type described in the '974 patent have been found to suffer from a few notable shortcomings.

As a first shortcoming, fastener dispensing tools of the type described in the '974 patent require a significant level of manual dexterity to operate. In particular, it has been found that certain users (e.g., arthritis patients) lack the dexterity required to either (i) handle the tool similarly to a syringe, (ii) drive the sharpened needles through the pair of objects to be coupled and/or (iii) actuate the device using his/her thumb.

As a second shortcoming, dual needle fastener dispensing tools of the type described in the '974 patent require a greater amount of hand strength than their single needle counterparts. Specifically, because a dual needle tool requires both the penetration of two needles through a layer of fabric as well as the ejection of a pair of transverse bars through its needles, it is to be understood that the force associated with each of the aforementioned steps is considerably greater than the force required to dispense a fastener from a single needle tool.

As a third shortcoming, dual needle fastener dispensing tools of the type described in the '974 patent are often more difficult to load than their single needle counterparts. Specifically, in addition to the fact that the fastener clip is somewhat difficult to handle, some users, on occasion, fail to adequately advance each runner bar of the clip in its proper position within the tool prior to actuation which, in turn, can lead to fastener jamming within the tool.

SUMMARY OF THE INVENTION

It is an object of the present invention to provide a new and improved button attachment kit.

It is another object of the present invention to provide a new and improved button attachment kit that is inexpensive to manufacture.

It is yet another object of the present invention to provide a new and improved button attachment kit that includes a fastener dispensing tool that is easy to load and use.

Accordingly, there is provided a button attachment kit comprising (a) a fastener clip, the fastener clip comprising a plurality of individual plastic fasteners, each plastic fastener comprising a filament, an enlargement formed on one end of the filament and a cross-bar formed on the other end of the filament; and (b) a tool for dispensing a plastic fastener from the fastener clip, the tool comprising (i) a needle with a sharpened tip, the needle being hollowed out along its length so as to define an elongated, longitudinal bore, the bore being dimensioned to fittingly receive the cross-bar of a fastener, (ii) a holder adapted to retain the needle, the holder being shaped to define a transverse feed slot behind the needle, the feed slot being dimensioned to receive at least a portion of the fastener clip, (iii) a handle telescopingly mounted on the holder and capable of slidable displacement relative thereto, (iv) a spring-biased ejection mechanism connected to the handle, the ejection mechanism comprising an elongated ejection rod that is disposed to selectively extend through the bore in the needle, (v) a front cap removably coupled to the handle over the needle, and (vi) a rear cap removably coupled to the handle.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings, wherein like reference numerals represent like parts:

FIG. 2(*a*) is an assembled, front perspective view of the button attachment kit shown in FIG. 1;

FIG. 2(*b*) is an enlarged, fragmentary, front perspective view of the button attachment kit shown in FIG. 2(*a*);

FIG. 2(*c*) is an assembled rear perspective view of the button attachment kit shown in FIG. 1;

FIG. 16(*c*) is an enlarged, fragmentary, left end perspective view of the fastener clip shown in FIG. 16(*b*) taken within circle C;

FIG. 18(*b*) is an enlarged section view of the button attachment kit shown in FIG. 17(*a*), taken along lines 18-18.

DETAILED DESCRIPTION OF PREFERRED EMBODIMENTS

Button Attachment Kit 11

Figure 1:
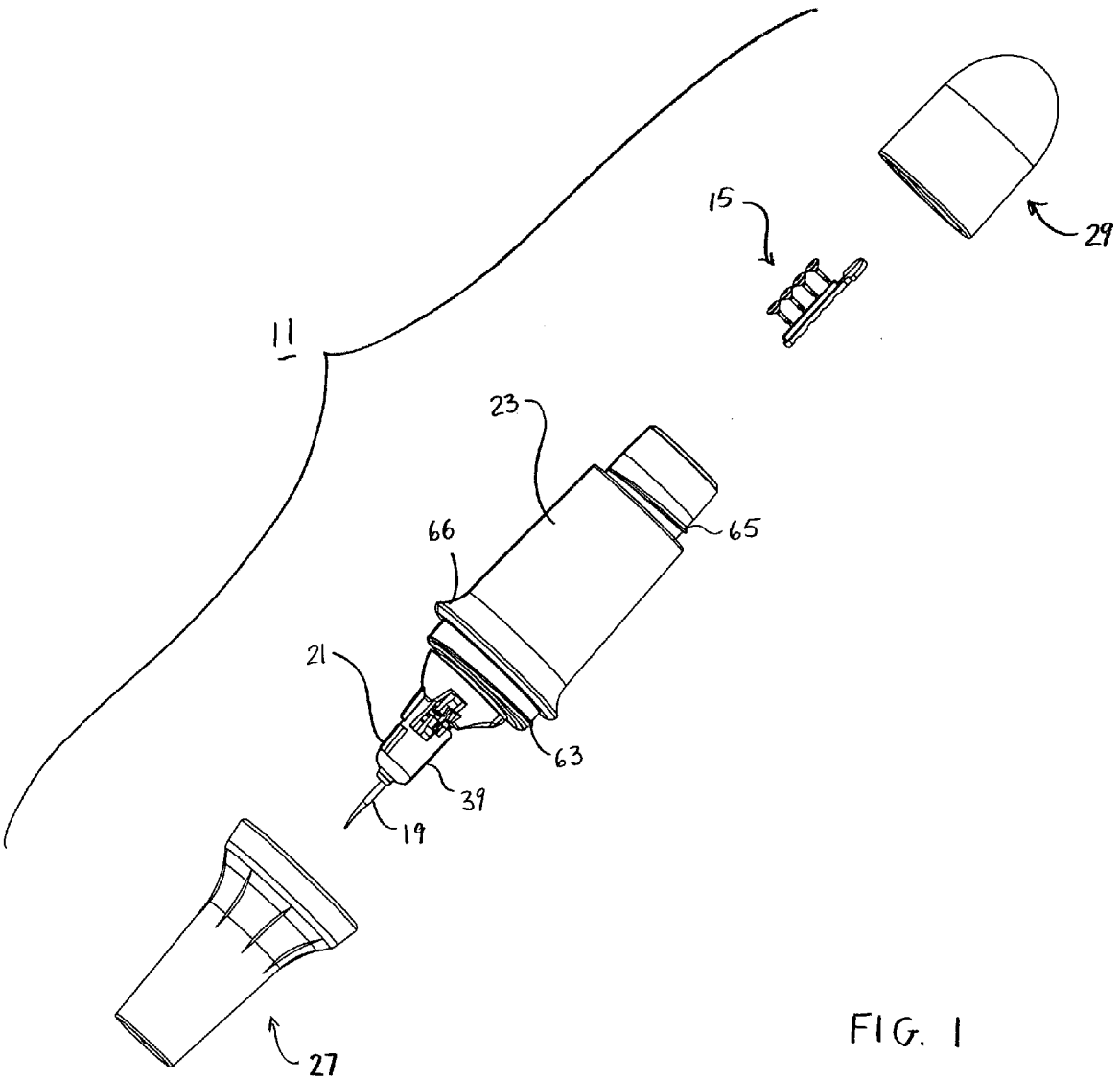
FIG. 1 is a partially exploded, front perspective view of a button attachment kit constructed according to the teachings of the present invention.
Figure 3:
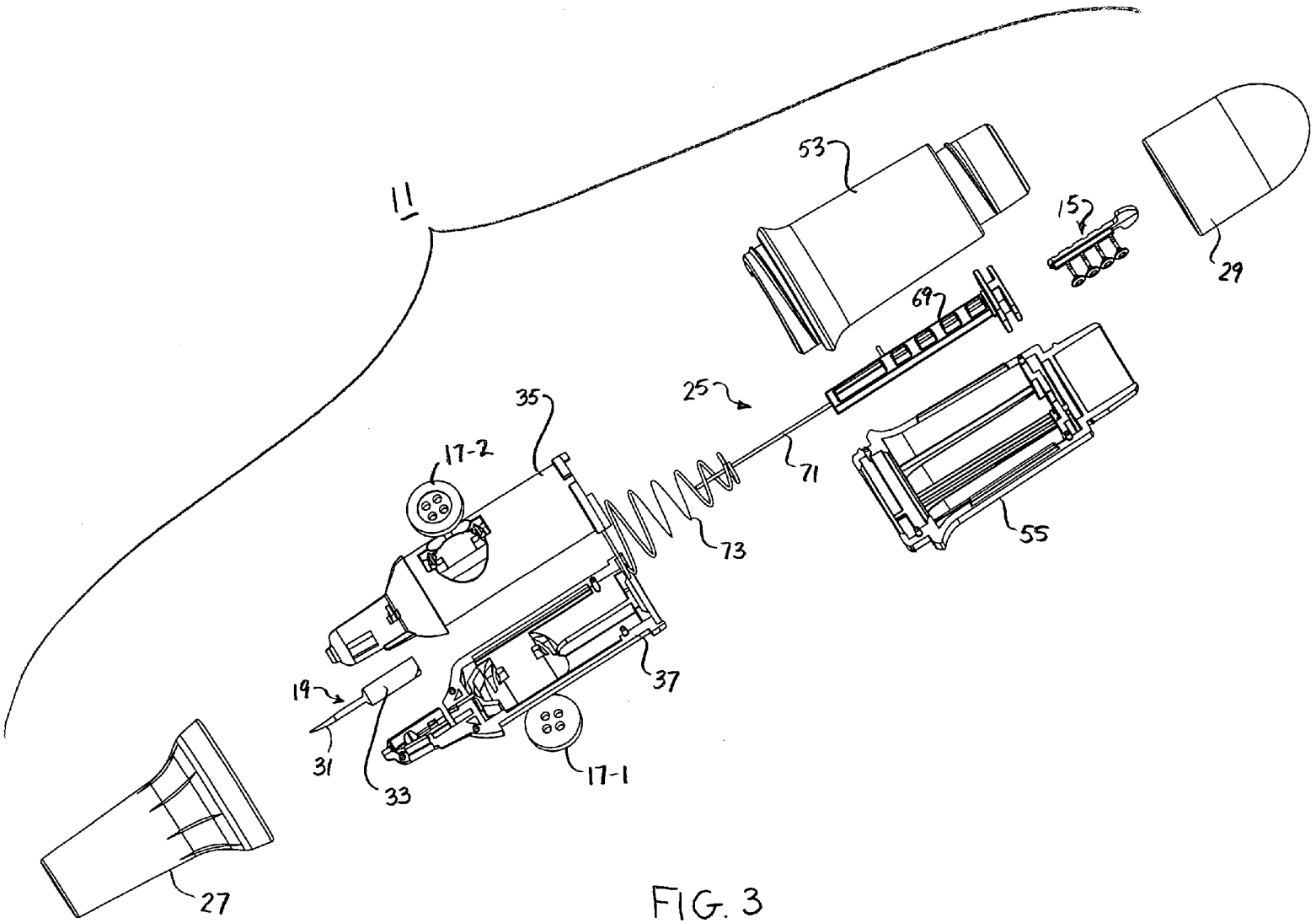
FIG. 3 is a fully exploded, top perspective view of the button attachment kit shown in FIG. 1
Figure 4A:
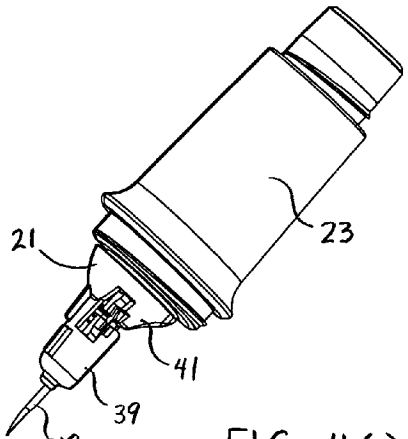
FIGS. 4(*a*)-(*d*) are front perspective, right end plan, front plan, and left end plan views, respectively, of the fastener dispensing tool shown in FIG. 2(*a*), the tool being shown with its front and rear caps removed therefrom.
Figure 4B:
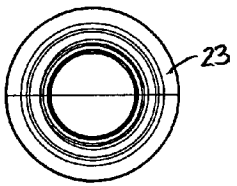
Figure 4C:
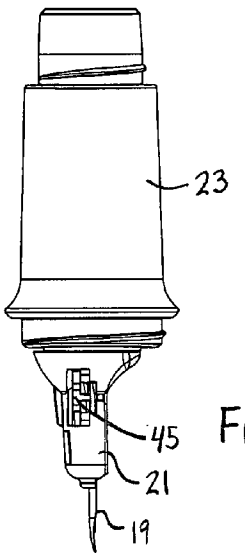
Figure 4D:
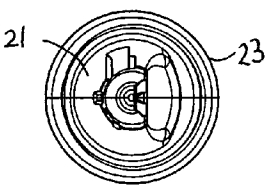

Referring to the drawings and in particular to FIGS. 1-3, there is shown a button attachment kit constructed according to the teachings of the present invention, the kit being represented generally by reference numeral 11. As will be described in detail below, kit 11 is particularly well-suited for use in re-attaching a decoupled button to an article of clothing, such as a shirt.

Kit 11 comprises a handheld fastener dispensing tool 13, a fastener clip 15 designed for use in conjunction with tool 13 and a pair of spare buttons 17-1 and 17-2.

Construction of Fastener Dispensing Tool 13

Referring now to FIGS. 1-15(*c*), fastener dispensing tool 13 comprises a hollowed needle 19, a holder 21 adapted to retain needle 19, a handle 23 slidably mounted on holder 21, an ejection mechanism 25 for dispensing an individual fastener from clip 15 through needle 19, a front cap 27 mounted onto the front of handle 23 (i.e. over needle 19), and a rear cap 29 mounted onto the rear of handle 23.

As seen most clearly in FIG. 3, needle 19 comprises a stem portion 31 and a base portion 33.

Stem portion 31, which may be made from stamped and rolled metal, is a generally cylindrical member terminating at one end in a sharpened tip that is designed for insertion through a garment or like object. Stem portion 31 is shaped to define a slotted bore extending longitudinally therethrough. In addition, the rear surface of stem portion 31 preferably includes a sharpened knife blade for separating an individual fastener from clip 13 during the fastener ejection process, which will be described further below.

Base portion 33 may be made of a plastic that has been insert-molded onto that end of stem portion 31 that is distal to its sharpened tip. (Alternatively, stem portion 31 and base portion 33 may be a unitary structure made of metal or another suitable material.) Base portion 33 is provided with a slotted longitudinal bore that is aligned with the bore in stem portion 31. Together, the bores of stem portion 31 and base portion 33 are appropriately dimensioned so that the cross-bar of a fastener from clip 15 may be inserted thereinto from the rear of base portion 33, traverse the length of needle 19 and then exit needle 19 through its open sharpened tip.

It should be noted that the particular construction of needle 19 could be modified without departing from the spirit of the present invention. For example, needle 19 may be of the type disclosed in the commonly owned U.S. application Ser. No. 10/006,779, which was filed on Nov. 5, 2001 in the name of William J. Cooper et al., and which is incorporated herein by reference.

Figure 5B:
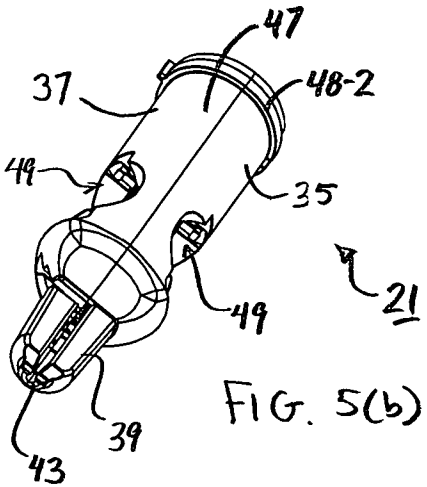
FIGS. 5(*a*)-(*c*) are front perspective, bottom perspective, and right end perspective views, respectively, of the holder shown in FIG. 2(*a*)
Figure 5A:
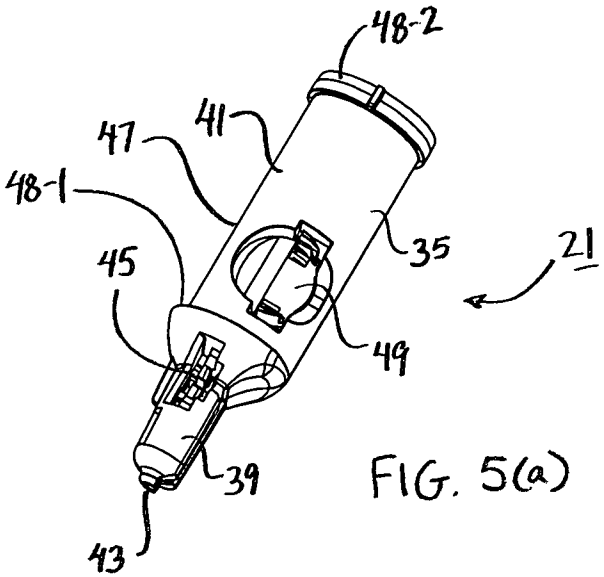
Figure 5C:
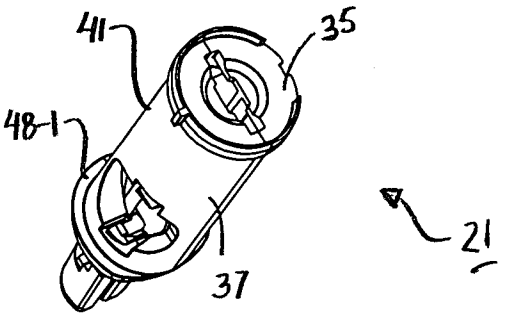
Figure 6A:
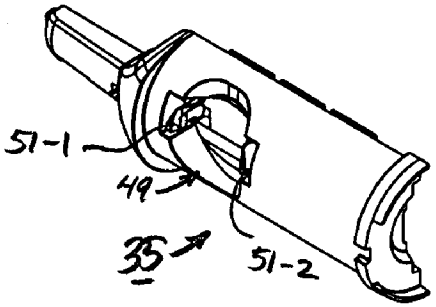
FIGS. 6(*a*)-(*f*) are rear perspective, front, top, rear plan, left end and right end views, respectively, of the left half of the holder shown in FIG. 5(*a*)
Figure 6B:
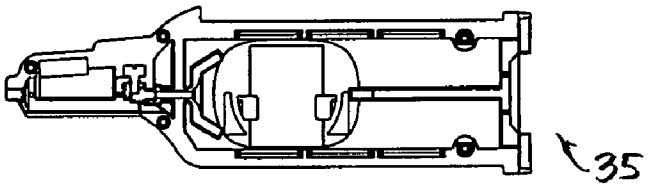
Figure 6C:
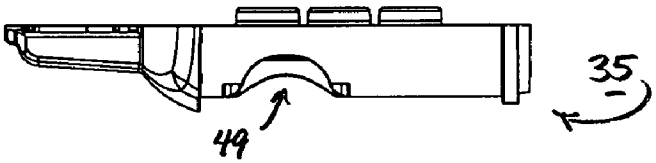
Figure 6D:
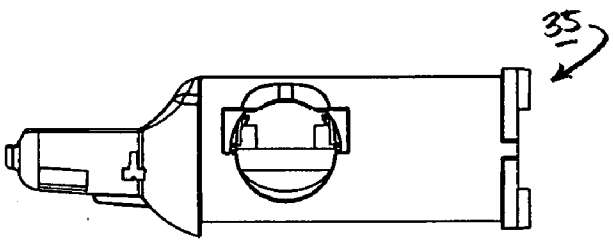
Figure 6F:
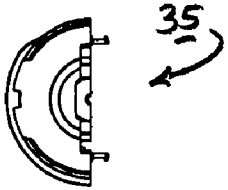
Figure 6E:
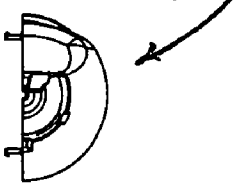
Figure 7A:
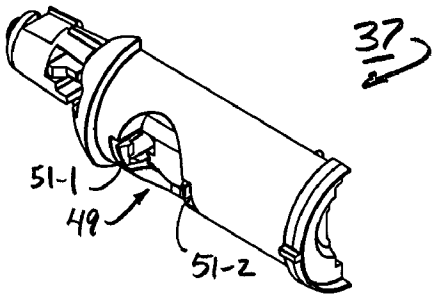
FIGS. 7(*a*)-(*f*) are front perspective, rear, bottom, front plan, right end and left end views, respectively, of the right half of the holder shown in FIG. 5(*a*)
Figure 7B:
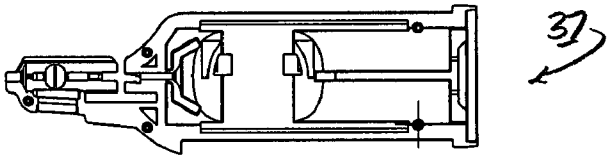
Figure 7C:
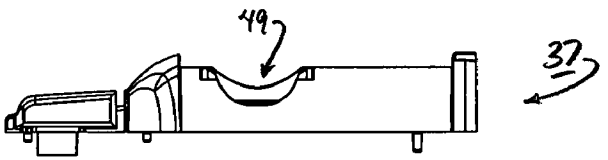
Figure 7D:
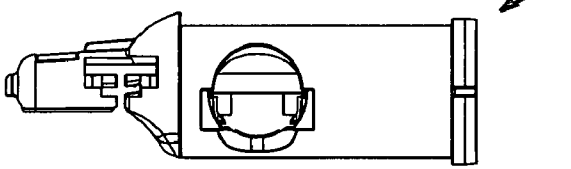
Figure 7E:
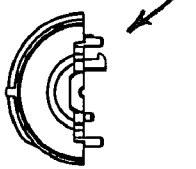
Figure 7F:
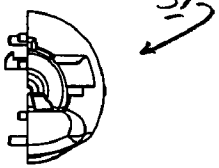

As seen most clearly in FIGS. 3, 5(*a*) and 5(*b*), holder, or base, 21 is an elongated, generally cylindrical member that includes a left half 35 (shown in isolation in FIGS. 6(*a*)-(*f*)) and a right half 37 (shown in isolation in FIGS. 7(*a*)-(*f*)) that are formed from any convenient and durable material, such as plastic, and that are permanently joined together by any conventional means, such through snap-engagement or ultrasonic welding. Together, left half 35 and right half 37 provide needle holder 21 with a narrow stem 39 at its front end and a widened cylindrical body 41 at its rear end.

A needle bore 43 is formed into the front of stem 39 and is dimensioned to fittingly receive a portion of needle 19. Accordingly, with needle 19 mounted securely within bore 43, the majority of stem portion 31, and in particular the sharpened tip of needle 19, projects orthogonally out from stem 39 of base 21, as seen most clearly in FIG. 1.

A transverse feed slot 45 is similarly formed into stem 39 directly behind needle 19, feed slot 45 being dimensioned to receive a portion of fastener clip 15. As will be described further below, fastener clip 15 is manually loaded into tool 13 through feed slot 45.

The outer diameter of cylindrical body 41 is slightly reduced along a central portion of its length so as to create an inner sleeve, or recess, 47. As will be described further below, inner sleeve 47 in holder 21 serves as a guide against which a portion of handle 23 may slide during actuation of tool 13. The formation of sleeve 47 into body 41 serves to create an annular flange 48-1 towards its front end and an enlarged annular platform 48-2 at its rear end.

A shallow circular cavity 49 is formed into the outer surface of each of left half 35 and right half 37. As seen most clearly in FIGS. 6(*a*) and 7(*a*), each cavity 49 is dimensioned to fittingly receive a button 17, with a pair of opposing, articulating, ratchet-shaped fingers 51-1 and 51-2 being formed into body 41 along the periphery of each cavity 49. Together, fingers 51 allow for each button 17 to be releasably snapped into place within a corresponding cavity 49 using a limited amount of insertion force, fingers 51 retaining button 17 in place until an adequate extraction force is applied thereto. In this manner, cavities 49 allow for the highly accessible storage of spare buttons 17 directly onto tool 13, which is highly desirable.

Figure 8B:
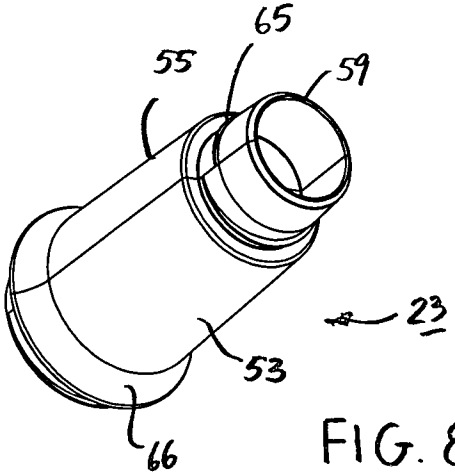
FIGS. 8(*a*)-(*c*) are front perspective, right end perspective and left end perspective views, respectively, of the push handle shown in FIG. 2(*a*)
Figure 8A:
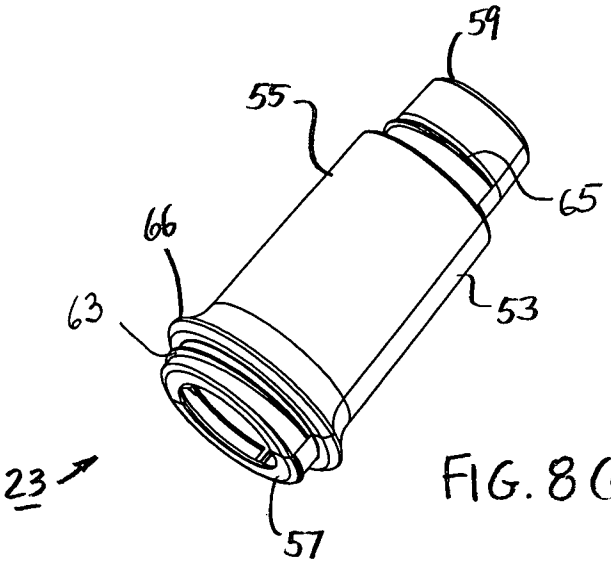
Figure 8C:
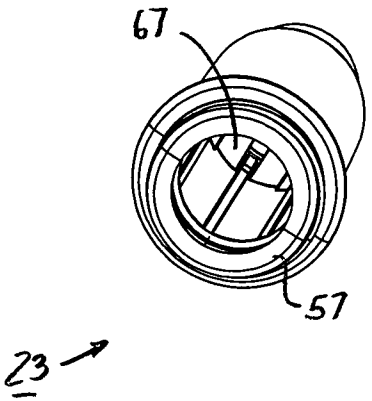
Figure 9A:
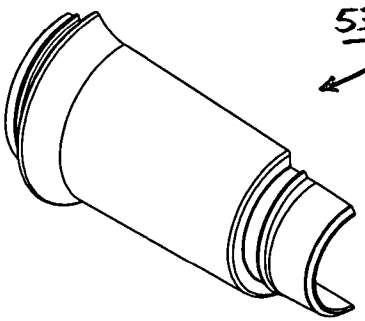
FIGS. 9(*a*)-(*f*) are rear perspective, front, top, rear plan, left end and right end views, respectively, of the left half of the push handle shown in FIG. 8(*a*)
Figure 9B:
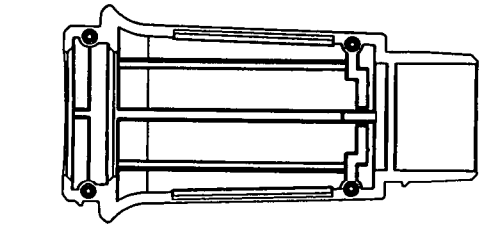
Figure 9C:
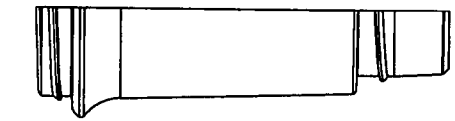
Figure 9D:
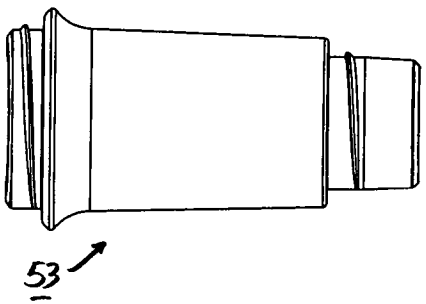
Figure 9E:
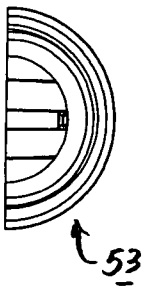
Figure 9F:
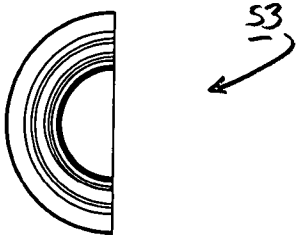
Figure 10A:
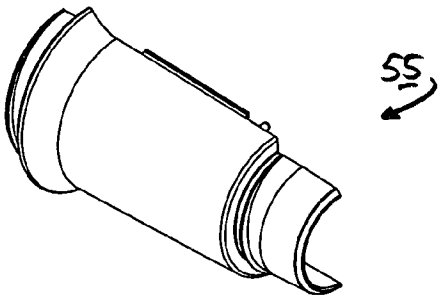
FIGS. 10(*a*)-(*f*) are front perspective, rear, top, front plan, left end and right end views, respectively, of the right half of the push handle shown in FIG. 9(*a*)
Figure 10B:
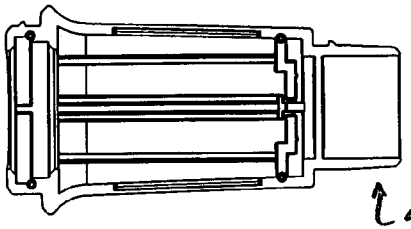
Figure 10C:
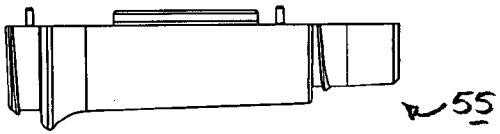
Figure 10D:
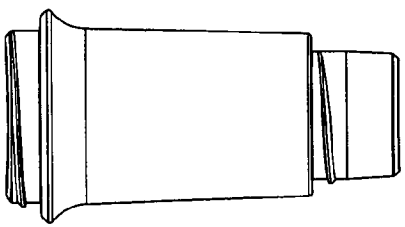
Figure 10E:
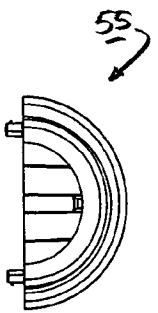
Figure 10F:
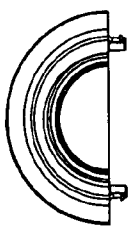
Figure 11A:
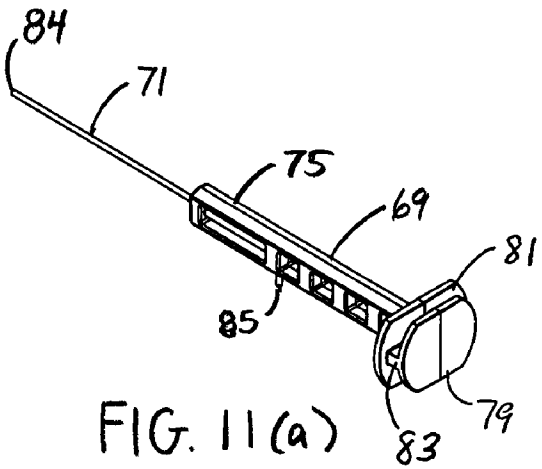
FIGS. 11(*a*)-(*e*) are front perspective, top, front plan, left end and right end views, respectively, of the ejection mechanism shown in FIG. 3, the ejection mechanism being shown with the compression spring removed therefrom.
Figure 11E:
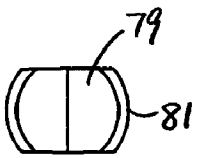
Figure 11B:
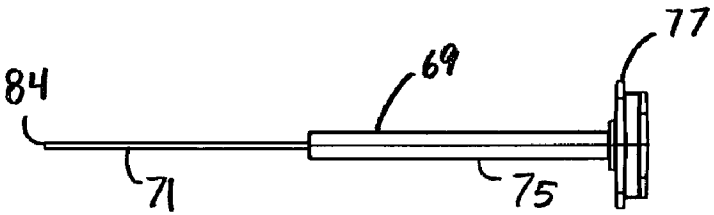
Figure 11C:
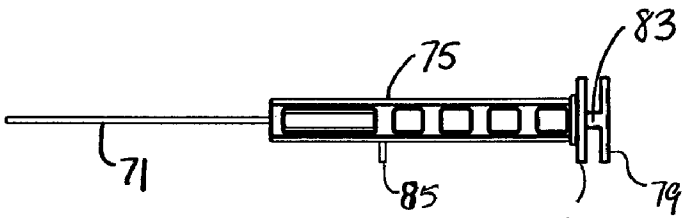
Figure 11D:
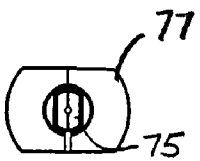

As seen most clearly in FIGS. 3, 8(*a*) and 8(*b*), handle, or push handle, 23 is an elongated, generally cylindrical member that includes a left half 53 (shown in isolation in FIGS. 9(*a*)-(*f*)) and a right half 55 (shown in isolation in FIGS. 10(*a*)-(*f*)) that are formed from any convenient and durable material, such as plastic, and that are permanently joined together by any conventional means, such through snap-engagement or ultrasonic welding. Together, left half 53 and right half 55 provide push handle 23 with a generally open front end 57 and an enclosed rear end 59.

A first helical threading 63 is formed into the outer surface of handle 23 at front end 57, threading 63 being used to releasably couple front cap 27 to push handle 23 over needle 19 and base 21. Similarly, a second helical threading 65 is formed into the outer surface of handle 23 at rear end 59, threading 65 being used to releasably couple rear cap 29 to the distal end of push handle 23, as will be described further in detail below. Furthermore, an outwardly protruding flange 66 is formed into the outer surface of handle 23 between front end 57 and rear end 59, flange 66 serving as a guard for protecting the hand of the user from contacting sharpened needle 19 during the fastener dispensing process.

As seen most clearly in FIG. 8(*c*), a slotted disc-shaped platform 67 is formed within the interior cavity defined by handle 23, platform 67 being spaced slightly in from enclosed rear end 59. As will be described further below, slotted platform 67 serves as a support on which ejection mechanism 25 is fixedly mounted.

Referring back to FIG. 3, ejection mechanism 25 comprises an ejector block 69, an ejector rod 71 coupled to ejector block 69 and a compression spring 73.

As seen most clearly in FIGS. 11(*a*)-(*e*), ejector block 69 is in the form of an elongated, unitary, generally T-shaped member that includes a rectangular front portion 75 that projects orthogonally out from an enlarged rear portion 77. Rear portion 77 is generally I-shaped in transverse cross-section and includes a rear plate 79 and a front plate 81 which are spaced slightly apart by a narrow rib 83. As can be appreciated, rear portion 77 of ejector block 69 is sized and shaped to be slidably coupled to slotted platform 67, thereby securing ejection mechanism 25 to push handle 23. Specifically, as seen most clearly in FIGS. 12(*a*) and 12(*b*), rib 83 is slidably disposed within the slot in platform 67, with rear plate 79 and front plate 81 disposed on opposite sides thereof. In this manner, rear portion 77 is held fixed in place within the rear of push handle 23.

As seen most clearly in FIGS. 11(*a*)-(*e*), ejector rod 71 is in the form of a thin, elongated, metallic, generally L-shaped pin that includes a first end 84 and a second end 85. Second end 85 of rod 71 is disposed through a fitted opening in front portion 75 of ejector block 69. In this manner, ejector rod 71 is fixedly coupled to ejector block 69, with the first end 84 of rod 71 protruding forward beyond the free end of front portion 75 in a co-axial relationship relative thereto. As will be described further below, ejector rod 71 is disposed in co-axial alignment with the longitudinal bore of needle 19 and is dimensioned to fittingly penetrate therethrough.

Figure 12B:
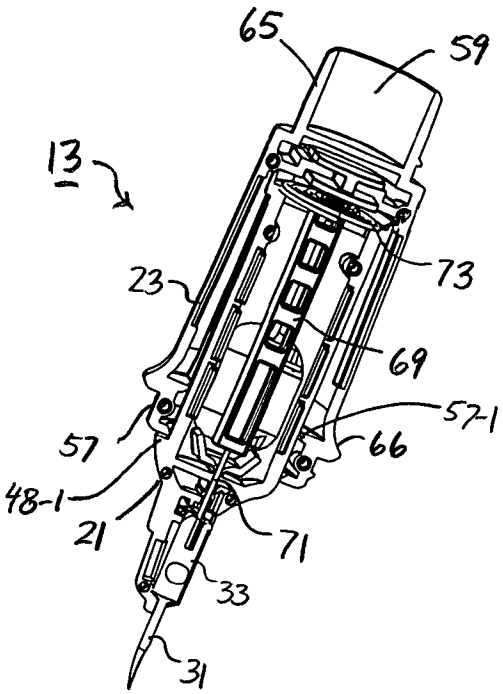
FIGS. 12(*a*)-(*b*) are section views of the fastener dispensing tool shown in FIG. 2(*a*), taken along lines 12-12, the tool being shown in its expanded and compressed states, respectively, the tool being shown with its front and rear caps removed therefrom.
Figure 12A:
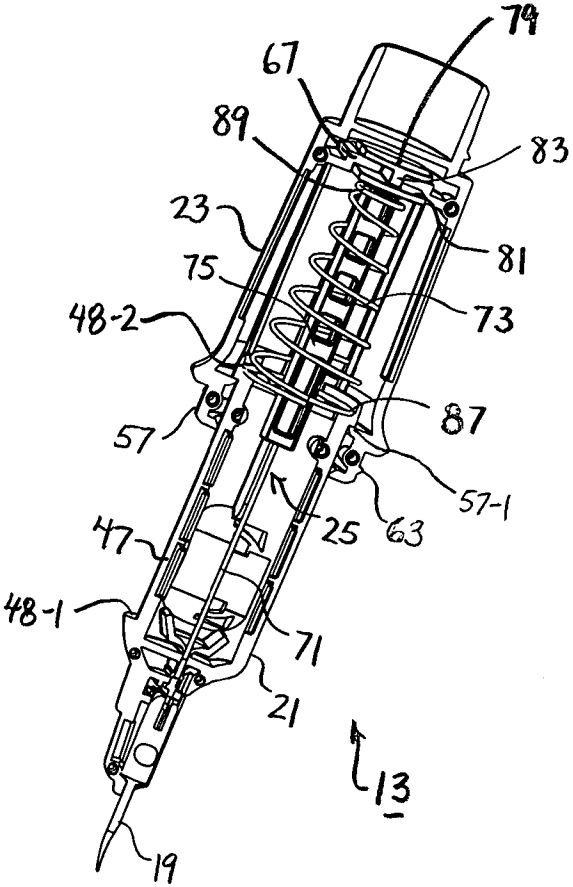
Figure 13A:
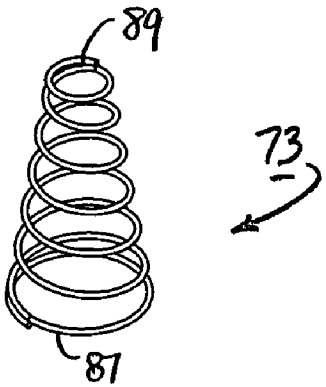
FIGS. 13(*a*)-(*c*) are front perspective, front plan, and left end plan views, respectively, of the compression spring shown in FIG. 3.
Figure 13B:
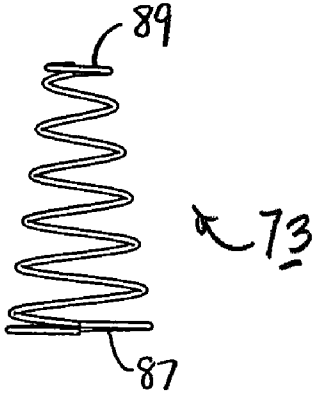
Figure 13C:
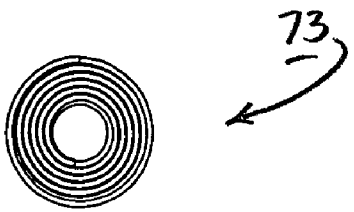
Figure 14A:
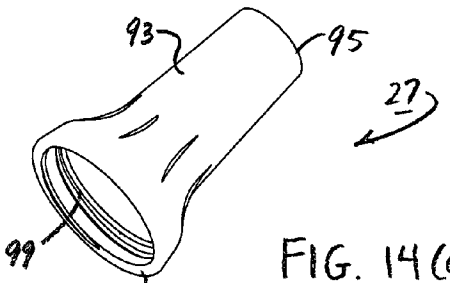
FIGS. 14(*a*)-(*f*) are rear perspective, right end perspective, left end perspective, right end plan, front plan and left end plan views, respectively, of the front cap shown in FIG. 1.
Figure 14B:
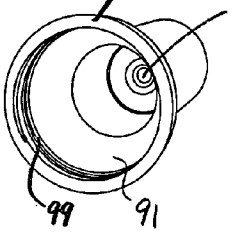
Figure 14C:
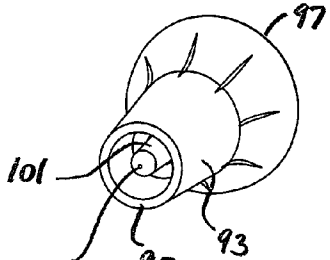
Figure 14D:
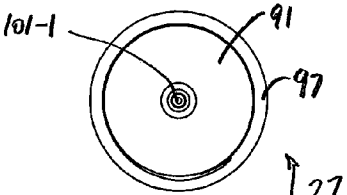
Figure 14E:
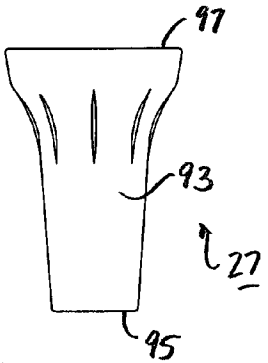
Figure 14F:
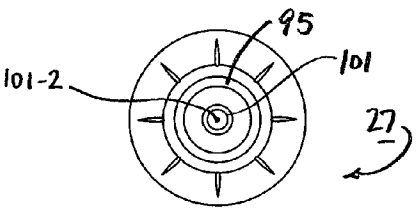
Figure 15A:
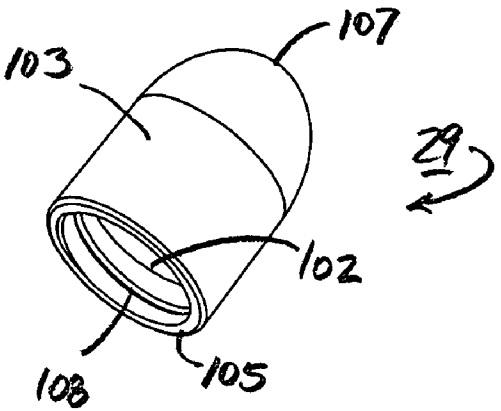
FIGS. 15(*a*)-(*c*) are front perspective, front plan and left end views, respectively, of the rear cap shown in FIG. 3.
Figure 15B:
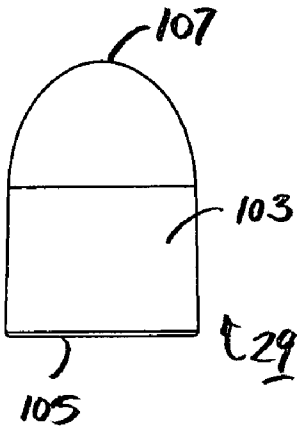
Figure 15C:
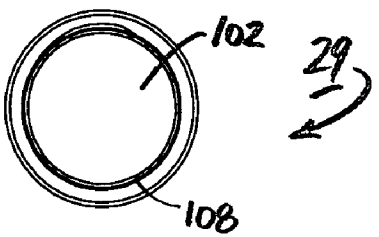

Referring now to FIGS. 13(*a*)-(*c*), compression spring 73 is in the form of a helical spring that includes a widened first end 87 and a narrowed second end 89. As seen most clearly in FIGS. 12(*a*) and 12(*b*), spring 73 wraps around the length of front portion 75 of ejector block 69 in a co-axial relationship relative thereto, with first end 87 disposed firmly against annular platform 48-2 of needle holder 21 (and held in place by a thin upstanding retaining wall formed along a portion of the outer periphery of platform 48-2) and second end 89 disposed firmly against the front plate 81 of ejector block 69.

In FIG. 12(*a*), tool 13 is shown in its expanded state. As can be seen, spring 73 naturally biases push handle 23 rearwardly from needle holder 21 such that ejector rod 71 axially withdraws from needle 19. An annular ridge 57-1 integrally formed into the inner surface of open front end 57 of push handle 23 eventually contacts the front edge of platform 48-2 to limit the rearward displacement of push handle 23.

In FIG. 12(*b*), tool 13 is shown in its compressed state. As can be seen, push handle 23 is driven forward relative to holder 21, with ejector rod 71 penetrating axially through needle 19. Open front end 57 of push handle 23 eventually abuts against flange 48-1 in holder 21 to limit further forward displacement of push handle 23. With push handle 23 disposed as such, spring 73 compresses to the extent necessary to allow for the forward displacement of ejector block 69. However, it is to be understood that upon withdrawal of the forward displacement of push handle 23, spring 73 resiliently expands which, in turn, rearwardly drives push handle 23 back to its expanded position.

Referring now to FIGS. 2(*a*), 2(*c*) and 14(*a*)-(*f*), front cap 27 is constructed as a elongated cylindrical cup that is preferably formed from a rigid and durable plastic material. As will be described further below, front cap 27 serves both as (i) a protective cover for needle 19 when tool 13 is not in use, and (ii) an anvil designed to support a layer of fabric during the button re-attachment process.

As can be seen, front cap 27 comprises an inner surface 91, an outer surface 93, a narrow, open front end 95 and a widened, open rear end 97. A helical threading 99 is integrally formed into inner surface 91 at rear end 97, threading 99 being configured to releasably engage threading 63 on push handle 23 when front cap 27 is screwed onto push handle 23.

A cylindrical protective sleeve 101 is integrally formed into and extends longitudinally through a portion of front cap 27 in coaxial alignment therewith. Sleeve 101 is represented herein as being in the form of a central elongated pin, generally circular in transverse cross-section, that includes an open rear end 101-1 and a closed front end 101-2 that lies generally flush with front end 95 of cap 27. As can be appreciated, sleeve 101 is dimensioned to fittingly receive stem portion 31 of needle 19 through its open rear end 101-1, thereby protecting the user from contacting the sharpened tip of needle 19 when tool 13 is not in use.

In addition, as noted above, front cap 27 is designed to serve as a support surface, or anvil, during the fastener dispensing process. Specifically, as seen most clearly in FIG. 14(*c*), the annular shape of front end 95 is preferably dimensioned to support a wide variety of standard sized circular buttons (e.g., a conventional 7/16 inch diameter shirt button). It should be noted that the closed tip, or front end 101-2, of sleeve 101 is preferably aligned in the direct center of front end 95. In this manner, with a button properly positioned on front end 95, front end 101-2 of sleeve 101 is disposed firmly against the underside of the button at the center point between all of the buttonholes. In this manner, sleeve 101 can support a button without interfering with the insertion of needle 19 through any buttonhole during the button re-attachment process, which is highly desirable.

Referring now to FIGS. 2(*a*)-(*b*) and 15(*a*)-(*c*), rear cap 29 is constructed as a rounded cup that is preferably formed from a rigid and durable plastic material. As can be seen, rear cap 29 comprises an inner surface 102, an outer surface 103, an open front end 105 and a rounded, closed rear end 107. A helical threading 108 is integrally formed into inner surface 102 of rear cap 29 at open front end 105, threading 108 being configured to releasably engage threading 65 to secure rear cap 29 to push handle 23.

It should be noted that rear cap 29 is hollowed out along its length so as to define an interior storage compartment that is dimensioned to retain one or more fastener clips 15. In this capacity, both fastener clip 15 and buttons 17 can be held directly on tool 13 when not in use. As a result, kit 11 can be stored as a unitary, compact element, thereby facilitating its handling.

Construction of Fastener Clip 15

Figure 16A:
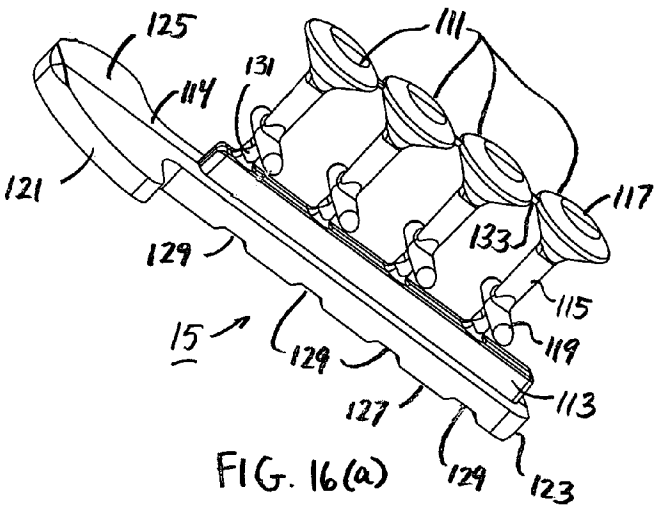
FIGS. 16(*a*)-(*b*) are rear perspective and left end perspective views, respectively, of the fastener clip shown in FIG. 1.
Figure 16B:
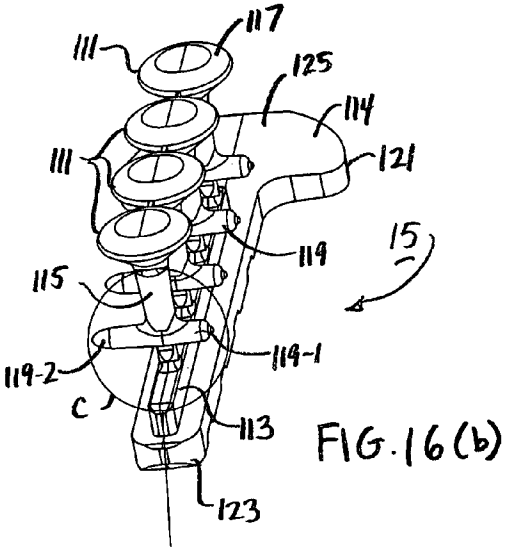
Figure 16C:
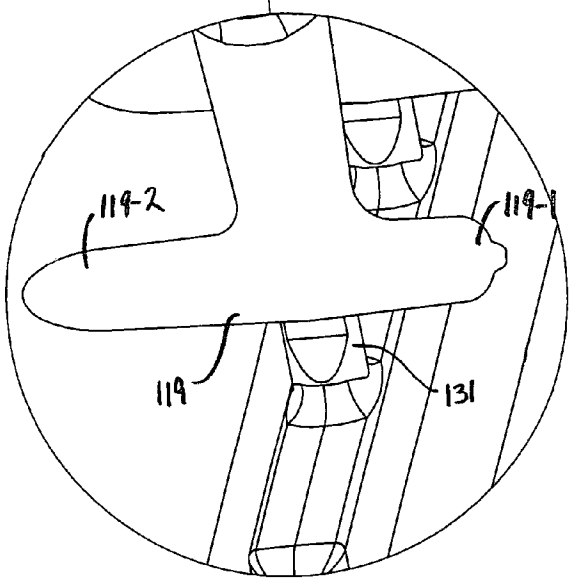

Referring now to FIGS. 16(*a*)-(*c*), fastener clip 15 is a unitary structure preferably molded from urethane or another similar material. Fastener clip 15 comprises four individual fasteners 111 that are attached to a common runner bar 113, the plurality of fasteners 111 being arranged in a parallel, front-to-back, spaced orientation. In turn, common runner bar 113 is formed on an enlarged, key-shaped handle 114 to facilitate handling of clip 15.

As seen most clearly in FIGS. 16(*a*)-(*b*), each fastener 111 comprises a filament 115, an enlargement 117 formed on one end of filament 115 and a cross-bar 119 formed at the opposite end of filament 115. Enlargement 117 is generally saucer-shaped in design and is of a size that is both (i) sufficient to preclude passing through the hole of a conventional shirt button and (ii) reduced and rounded to render it relatively inconspicuous in nature.

As seen most clearly in FIG. 16(*c*), each cross-bar 119 has a bullet-shaped design for optimal performance. Specifically, each cross-bar 119 includes a shortened rear portion 119-1 that is rounded (i.e., radial) at its free end to minimize irritation against skin and a lengthened front portion 119-2 that tapers gradually to a narrower (i.e., more fine) rounded tip to facilitate insertion through a layer of material, the overall length of cross-bar 119 being sized to ensure adequate retentive capabilities and, as such, preclude unintentional withdrawal from the layer of material. Due to the different lengths of rear and front portions 119-1 and 119-2, each filament 115 appears connected to its respective cross-bar in an offset relationship in relation to its midpoint, or center (i.e., with filament 115 connected to cross-bar 119 at a location that is closer to its rear end than its front end).

Common runner bar 113 is generally in the form of an elongated block that is generally rectangular in transverse cross-section, as seen most clearly in FIG. 16(*a*). Common runner bar 113 is of a length that is sufficient to receive the plurality of fasteners 111.

Handle 114 has a generally key-shaped design and comprises a first end 121, a second end 123, a flattened top surface 125 and a flattened bottom surface 127. As can be seen, runner bar 113 is formed onto top surface 125 proximate second end 123.

First end 121 of handle 114 is preferably in the form of an enlarged flattened paddle that serves to facilitate handling of clip 15 (in particular, during the process of loading clip 15 into tool 13). In addition, bottom surface 127 is shaped to define four, spaced apart notches 129 along its length. As will be described further below, notches 129 assist in the process of manually indexing each fastener 111 into its proper position within tool 13 prior to the fastener dispensing process.

Each fastener 111 is connected to common runner bar 113 by a severable stub 131. As will be described further below, each fastener 111 is separated from the remainder of clip 15 by severing its corresponding stub 131. It should also be noted that enlargements 117 of adjacent fasteners 111 are represented herein as being integrally joined together by a thin connector 133. However, it is to be understood that each connector 133 is of limited strength and can be easily severed by lightly pulling adjacent enlargements 117 apart from one another.

Operation of Kit 11

As noted above, kit 11 is designed to be stored as a unitary and compact item, as seen most clearly in FIGS. 2(*a*) and 2(*c*). Specifically, when not in use, kit 11 is generally in the form of a shortened tubular member, slightly larger than the size of a conventional lipstick case, which is highly desirable.

When an article of clothing requires the attachment of a button 17 thereto, the user is first required to unscrew front cap 27 from push handle 23. It is to be understood that upon the removal of front cap 27 from push handle 23, the resilient nature of spring 73 drives push handle 23 rearward until tool 13 is disposed in its expanded position.

Figure 17B:
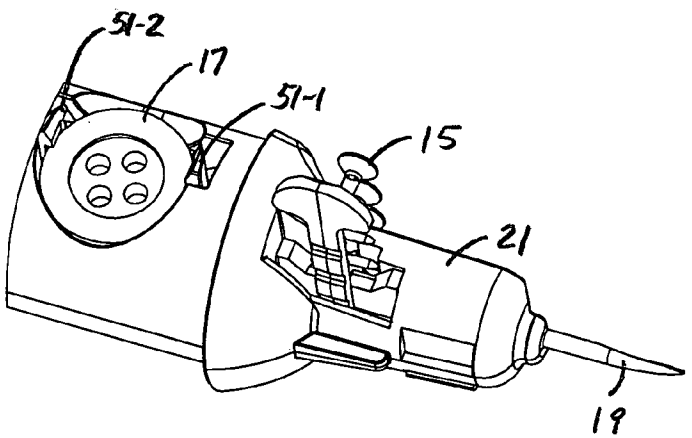
FIGS. 17(*a*)-(*b*) are front perspective and enlarged, fragmentary, front perspective views, respectively, of the button attachment kit shown in FIG. 2(*a*), the button attachment kit being shown without the front end cap and with a fastener clip loaded in the tool.
Figure 17A:
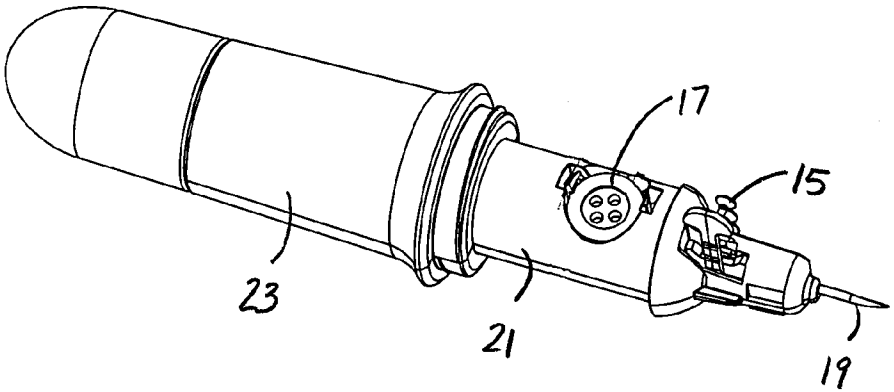

With front cap 27 removed from push handle 23, it is now required that a fastener clip 15 be inserted into feed slot 45. To retrieve a fastener clip 15 for use, rear cap 29 is unscrewed from push handle 23, thereby providing access to the fastener storage compartment within cap 29. Using enlarged paddle 121, second end 123 of fastener clip 15 is manually inserted into feed slot 45 in needle holder 21, as seen most clearly in FIGS. 17(*a*)-(*b*) and 18(*a*).

Figure 18B:
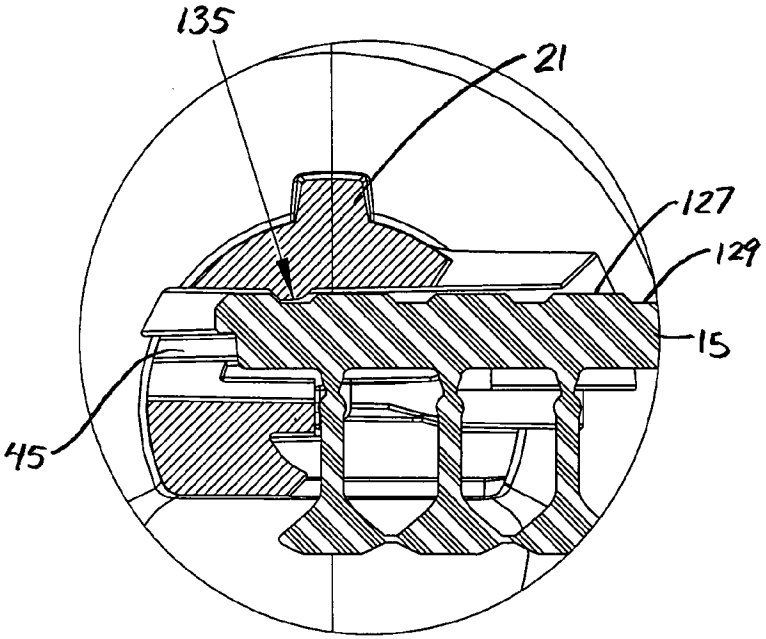
FIG. 18(*a*) is a top plan view of the button attachment kit shown in FIG. 17(*a*)
Figure 18A:
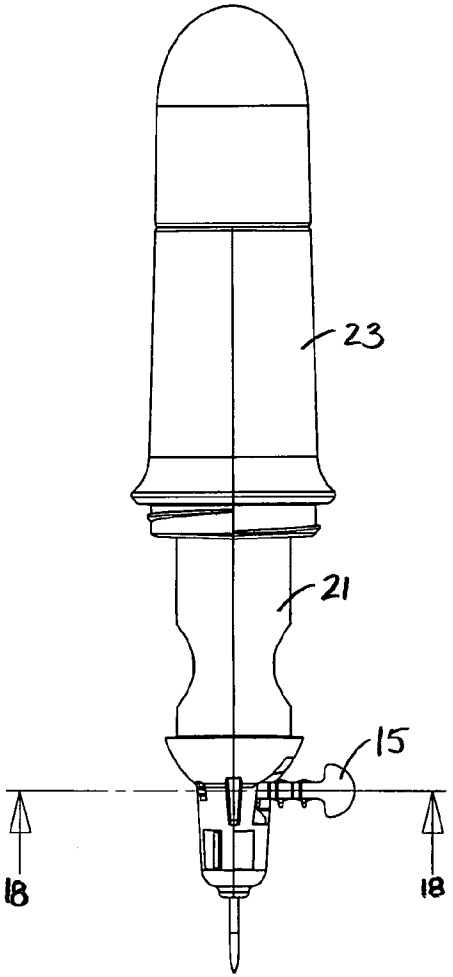

It should be noted that a detent, or protrusion, 135 is formed in holder 21 that protrudes into feed slot 45, as seen most clearly in FIG. 18(*b*). In this manner, clip 15 is advanced into feed slot 45 until detent 135 snaps into place within a corresponding notch 129 in fastener clip 15. As can be appreciated, the auditory and tactile response achieved through the aforementioned snap engagement between detent 135 and notch 129 notifies the user that clip 15 has been properly fed into tool 13.

With clip 15 properly fed into tool 13, the user first places rear end 97 of front cap 27 directly onto a flat work surface, such as a table, and then disposes the article of clothing which requires a button 17 directly on top of front end 95 of cap 27. The article is then positioned such that the exact area to receive button 17 is aligned directly above front end 95. A button, which may be one of the spare buttons 17 included in kit 11 or an additional button supplied from an alternative source (e.g., a button that has inadvertently detached from the article), is then positioned on the article in direct alignment with annular front end 95 of cap 27. In this capacity, it is to be understood that front cap 27 serves as an anvil for supporting the article and the button during the attachment process.

At this time, the user grasps handle 23 in any comfortable manner (e.g., by grasping handle 23 in a similar fashion to how one would grasp the handle of a ski pole) and manually drives the sharpened tip of needle 19 downward through both a hole in the button and the desired article. Once the front end of stem 39 abuts against the button, thereby limiting further downward displacement of tool 13, the continued downward force applied by the user in turn causes push handle 23 to slide downward along holder 21 in a telescoping relationship relative thereto. As push handle 23 slides along holder 21, spring 73 compresses and ejector rod 71 is displaced forward within tool 13.

During this process, ejector rod 71 contacts the cross-bar 119 of the lowermost fastener 111 in clip 15 and in turn axially displaces the cross-bar 119 through needle 19. As the cross-bar 119 is driven through needle 19, its corresponding stub 131 is urged against the sharpened edge of the knife blade on needle 19, thereby severing the lowermost fastener 111 from the remainder of clip 15. Accordingly, ejector rod 71 is able to drive the separated cross-bar 119 axially through needle 19 until it passes through the open needle tip, with enlargement 117 and cross-bar 119 now disposed on opposite surfaces of the button and the article of clothing. As such, the dispensed fastener 111 fixedly secures button 17 to the article, filament 115 stretching to the extent necessary to accommodate fabrics of varying thicknesses, which is highly desirable.

With the fastener 111 properly dispensed, the user withdraws tool 13 from the article, the elimination of the actuation force causing spring 73 to resiliently return tool 13 to its expanded state. If additional fasteners 111 are required, the user advances clip 15 into tool 13 until detent 135 engages the next successive notch 129 in clip 15. However, if no further fasteners 111 are required, the user may opt to (i) withdraw clip 15 from tool 13, (ii) return the partially used clip back to the fastener storage compartment in tool 13 by screwing rear cap 29 onto push handle 23 and (iii) screw front cap 27 back onto handle 23 over needle 19. As such, kit 11 is restored to its compact, storage-ready configuration until further use is required.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A button attachment kit comprising:

(a) a fastener clip, the fastener clip comprising a plurality of individual plastic fasteners, each plastic fastener comprising a filament, an enlargement formed on one end of the filament and a cross-bar formed on the other end of the filament; and (b) a tool for dispensing a plastic fastener from the fastener clip, the tool comprising:

(i) a needle with a sharpened tip, the needle being hollowed out along its length so as to define an elongated, longitudinal bore, the bore being dimensioned to fittingly receive the cross-bar of a fastener, (ii) a holder adapted to retain the needle, the holder being shaped to define a transverse feed slot behind the needle, the feed slot being dimensioned to receive at least a portion of the fastener clip, (iii) a handle telescopingly mounted on the holder and capable of slidable displacement relative thereto, (iv) a spring-biased ejection mechanism connected to the handle, the ejection mechanism comprising an elongated ejection rod that is disposed to selectively extend through the bore in the needle, (v) a front cap removably connected to the handle over the needle, and (vi) a rear cap removably connected to the handle so as to define an interior storage compartment therebetween, the interior storage compartment being dimensioned to receive at least one fastener clip.

2. The button attachment kit of claim 1 wherein the button attachment kit additionally comprises a button.

3. The button attachment kit of claim 2 wherein the holder is shaped to define a cavity that is dimensioned to fittingly receive the button.

4. The button attachment kit of claim 1 wherein the outer surface of the holder is recessed along a portion of its length to limit the displacement range of the handle.

5. The button attachment kit of claim 1 wherein the push handle comprises an open front end and an enclosed rear end, the holder extending axially within the handle and projecting partially out through the open front end.

6. The button attachment kit of claim 5 wherein the outer surface of the handle is provided with an outwardly protruding flange for guarding against inadvertent contact with the sharpened tip of the needle.

7. The button attachment kit of claim 1 wherein the ejection mechanism comprises:

(a) an ejector block fixedly connected to the handle, (b) an ejector rod fixedly connected to the ejector block, and (c) a compression spring disposed at one end against the ejector block and at the other end against the holder, the compression spring being naturally biased to urge the handle rearwardly away from the holder.

8. The button attachment kit of claim 1 wherein the front cap is in the form of a cup that includes an inner surface, an outer surface, an annular front end and an open rear end.

9. The button attachment kit of claim 8 wherein the front cap additionally includes a longitudinal sleeve that includes an open rear end and a closed front end, the open rear end being dimensioned to fittingly receive the sharpened tip of the needle.

10. The button attachment kit of claim 9 wherein the closed front end of the longitudinal sleeve is centered and flush with the annular front end.

11. The button attachment kit of claim 1 wherein the rear cap comprises an inner surface, an outer surface, an open front end and a closed rear end.

12. The button attachment kit of claim 1 wherein the cross-bar of each fastener is bullet-shaped.

13. The button attachment kit of claim 12 wherein the cross-bar of each fastener includes a shortened rear portion that is rounded at its free end and a lengthened front portion that tapers gradually to a narrower rounded tip.

14. The button attachment kit of claim 1 wherein the fastener clip additionally comprises:

(a) a common runner bar, each fastener being connected to the common runner bar by a severable stub, and (b) an enlarged handle on which the common runner bar is mounted.

15. The button attachment kit of claim 14 wherein the handle includes an enlarged first end, a second end, a flattened top surface and a flattened bottom surface, the common runner bar being mounted on the flattened top surface.

16. A button attachment kit comprising:

(a) a fastener clip, the fastener clip comprising a plurality of individual plastic fasteners, each plastic fastener comprising a filament, an enlargement formed on one end of the filament and a cross-bar formed on the other end of the filament;

(b) a button; and (c) a tool for dispensing a plastic fastener from the fastener clip, the tool comprising:

(i) a needle with a sharpened tip, the needle being hollowed out along its length so as to define an elongated, longitudinal bore, the bore being dimensioned to fittingly receive the cross-bar of a fastener, (ii) a holder adapted to retain the needle, the holder being shaped to define a transverse feed slot behind the needle, the feed slot being dimensioned to receive at least a portion of the fastener clip, the holder being shaped to define a cavity that is dimensioned to fittingly receive the button, the holder additionally including a pair of opposing, articulating fingers that are designed to releasably retain the button within the cavity, (iii) a handle telescopingly mounted on the holder and capable of slidable displacement relative thereto, (iv) a spring-biased ejection mechanism connected to the handle, the ejection mechanism comprising an elongated ejection rod that is disposed to selectively extend through the bore in the needle, (v) a front cap removably coupled to the handle over the needle, and (vi) a rear cap removably coupled to the handle.

17. A button attachment kit comprising:

(a) a fastener clip, the fastener clip comprising a plurality of individual plastic fasteners, each plastic fastener comprising, (i) a filament, (ii) an enlargement formed on one end of the filament, (iii) a cross-bar formed on the other end of the filament, (iv) a common runner bar, each fastener being connected to the common runner bar by a severable stub, and (v) an enlarged handle on which the common runner bar is mounted, the handle including an enlarged first end, a second end, a flattened top surface and a flattened bottom surface, the common runner bar being mounted on the flattened top surface, the bottom surface of the handle being shaped to define a plurality of spaced apart notches, and (b) a tool for dispensing a plastic fastener from the fastener clip, the tool comprising:

(i) a needle with a sharpened tip, the needle being hollowed out along its length so as to define an elongated, longitudinal bore, the bore being dimensioned to fittingly receive the cross-bar of a fastener, (ii) a holder adapted to retain the needle, the holder being shaped to define a transverse feed slot behind the needle, the feed slot being dimensioned to receive at least a portion of the fastener clip, (iii) a handle telescopingly mounted on the holder and capable of slidable displacement relative thereto, (iv) a spring-biased ejection mechanism connected to the handle, the ejection mechanism comprising an elongated ejection rod that is disposed to selectively extend through the bore in the needle, (v) a front cap removably coupled to the handle over the needle, and (vi) a rear cap removably coupled to the handle.

18. The button attachment kit of claim 17 wherein the holder for the tool is shaped to include a detent that protrudes into the feed slot, the detent being dimensioned to sequentially engage the plurality of notches formed in the handle of the fastener clip to facilitate proper indexing of the fastener clip in the tool.

* * * * *